US005879213A

United States Patent [19]

Williams, Jr. et al.

[11] Patent Number: 5,879,213

[45] Date of Patent: Mar. 9, 1999

[54] INFLATABLE LIFE SAVING GARMENT

[76] Inventors: Leroy Williams, Jr.; Taris D. Williams, both of 30 Third St., Cleveland, Miss. 38732

[21] Appl. No.: 31,506

[22] Filed: Feb. 26, 1998

[51] Int. Cl.[6] ..... B63C 9/08

[52] U.S. Cl. ..... 441/108; 441/93

[58] Field of Search ..... 441/80, 88, 90–96, 441/106–108, 111–119; 222/5, 85, 80, 81

[56] References Cited

U.S. PATENT DOCUMENTS 1,460,430 7/1923 Morse ..... 441/113
1,514,435 11/1924 Chatham ..... 441/112
2,784,426 3/1957 Boyle et al. ..... 441/113

FOREIGN PATENT DOCUMENTS 416842 7/1925 Germany ..... 441/112

*Primary Examiner*—Ed L. Swinehart

[57] ABSTRACT

An inflatable garment is provided including a hollow belt. Also included is a pair of hollow shoulder straps with bottom terminal ends of the shoulder straps integrally coupled to the belt in communication therewith. Also included is an inflation assembly for inflating both the belt and shoulder straps.

11 Claims, 2 Drawing Sheets

FIG 1
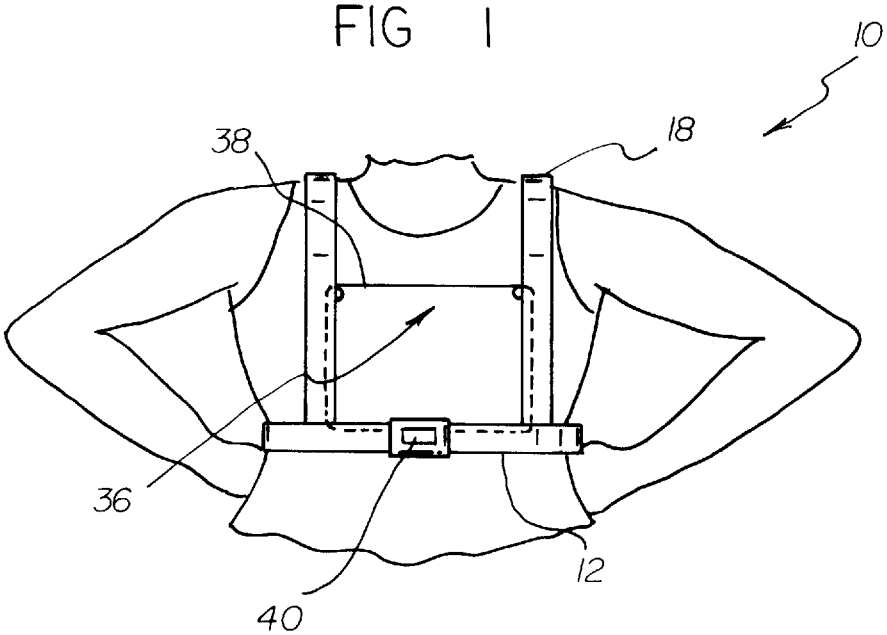
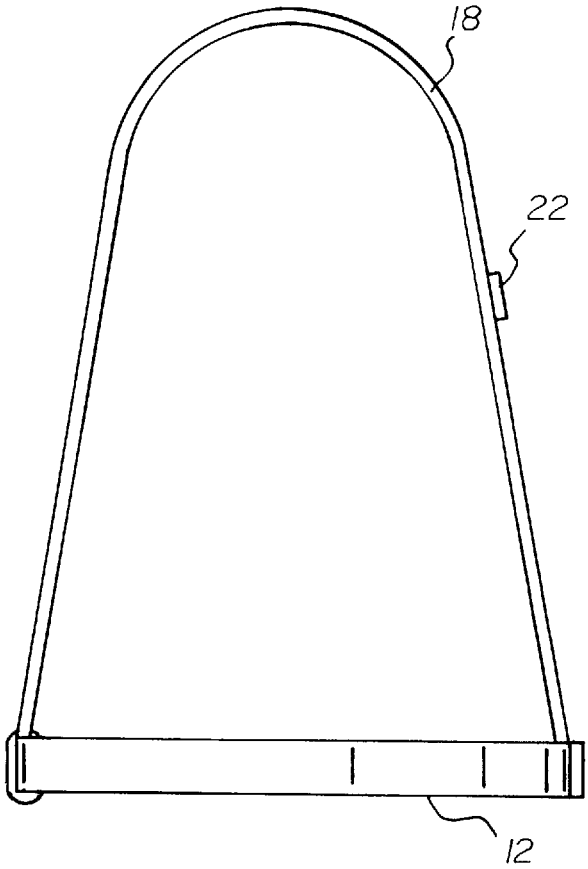
FIG 2

FIG 3
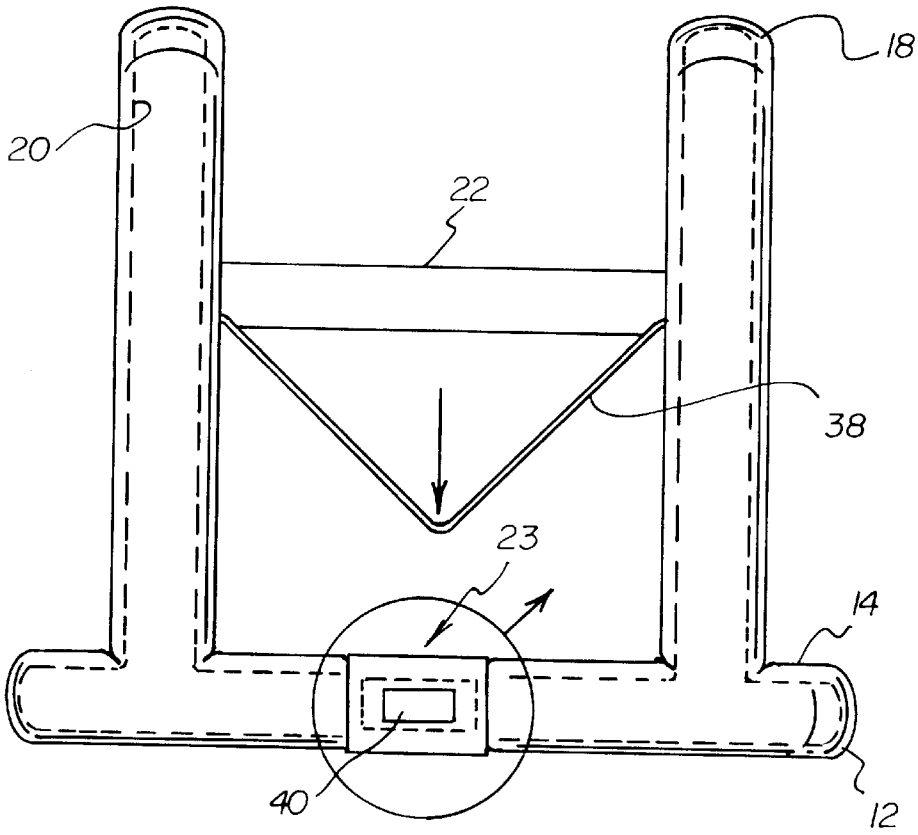
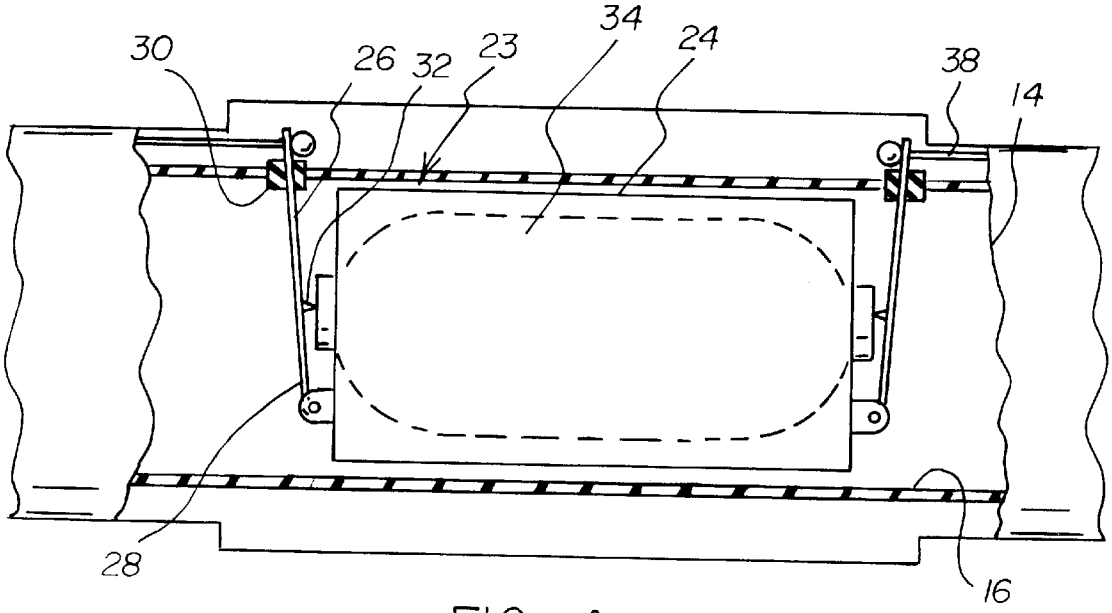
FIG 4

INFLATABLE LIFE SAVING GARMENT

BACKGROUND OF THE INVENTION

1. Field of the Invention

The present invention relates to life jackets and more particularly pertains to a new inflatable life saving garment for supporting a drowning person within a body of water.

2. Description of the Prior Art

The use of life jackets is known in the prior art. More specifically, life jackets heretofore devised and utilized are known to consist basically of familiar, expected and obvious structural configurations, notwithstanding the myriad of designs encompassed by the crowded prior art which have been developed for the fulfillment of countless objectives and requirements.

Known prior art life jackets include U.S. Pat. No. 4,060,867; U.S. Pat. No. 4,324,234; U.S. Pat. No. 4,498,882; U.S. Pat. No. 2,128,423; U.S. Pat. No. 3,329,982; and Foreign Patents WO 90/15013 and WO 92/03332.

In these respects, the inflatable life saving garment according to the present invention substantially departs from the conventional concepts and designs of the prior art, and in so doing provides an apparatus primarily developed for the purpose of supporting a drowning person within a body of water.

SUMMARY OF THE INVENTION

In view of the foregoing disadvantages inherent in the known types of life jackets now present in the prior art, the present invention provides a new inflatable life saving garment construction wherein the same can be utilized for supporting a drowning person within a body of water.

The general purpose of the present invention, which will be described subsequently in greater detail, is to provide a new inflatable life saving garment apparatus and method which has many of the advantages of the life jackets mentioned heretofore and many novel features that result in a new inflatable life saving garment which is not anticipated, rendered obvious, suggested, or even implied by any of the prior art life jackets, either alone or in any combination thereof.

To attain this, the present invention generally comprises a belt having an outer sleeve constructed from a flexible material. As shown in the Figures, the outer sleeve has a thin horizontally oriented rectangular configuration with a hollow interior. The outer sleeve of the harness has a hollow tube mounted therein which is constructed from an elastomeric material. Also included is a pair of shoulder straps each having an outer sleeve constructed from a flexible material and defined by a vertically oriented rectangular configuration with a hollow interior. Bottom terminal ends of the shoulder straps are integrally coupled in perpendicular relationship with the belt. The outer sleeve of each shoulder strap has a hollow tube constructed from an elastomeric material mounted therein. The tubes of the shoulder straps each remain in communication with that of the belt. Next provided is a back strap coupled in perpendicular relationship between a central extent of a rear portion of the shoulder straps. In use, the back strap serves to maintain the shoulder straps in parallel. A helium assembly includes a hollow cylindrical housing with open ends mounted within the tube of the belt at a front extent thereof. A pair of plugs each include a pivot arm with a lower end pivotally mounted on a lower extent of an associated one of the ends of the housing. An upper end of the plugs extend through a grommet formed in a top of the tube. Mounted on a central extent of each pivot arm is a stopper. A cylindrical helium tank is mounted within the housing and is equipped with a pair of ends each having an outlet formed therein. Each pivot arm has an unbiased orientation with the stoppers each plugging the corresponding outlet of the helium tank for sealing the same. Finally, an actuation assembly includes a pair of pull cords each having a first end mounted to the upper end of an associated one of the pivot arms. A second end of each pull cord extends from a central extent of a front portion of the corresponding shoulder strap. As shown in FIG. 3, the second ends of the pull cords are integrally coupled such that a portion of the pull cord spans a chest of a user during use. A majority of a length of the pull cords are situated between the tube and the outer sleeve of the belt and shoulder straps. In operation, the belt and the shoulder straps are adapted to inflate upon the second ends of the pull cords being pulled which in turn biases the pivot arms.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new inflatable life saving garment apparatus and method which has many of the advantages of the life jackets mentioned heretofore and many novel features that result in a new inflatable life saving garment which is not anticipated, rendered obvious, suggested, or even implied by any of the prior art life jackets, either alone or in any combination thereof.

It is another object of the present invention to provide a new inflatable life saving garment which may be easily and efficiently manufactured and marketed.

It is a further object of the present invention to provide a new inflatable life saving garment which is of a durable and reliable construction.

An even further object of the present invention is to provide a new inflatable life saving garment which is susceptible of a low cost of manufacture with regard to both materials and labor, and which accordingly is then susceptible of low prices of sale to the consuming public, thereby making such inflatable life saving garment economically available to the buying public.

Still yet another object of the present invention is to provide a new inflatable life saving garment which provides in the apparatuses and methods of the prior art some of the advantages thereof, while simultaneously overcoming some of the disadvantages normally associated therewith.

Still another object of the present invention is to provide a new inflatable life saving garment for supporting a drowning person.

Even still another object of the present invention is to provide a new inflatable life saving garment that includes a hollow belt. Also included is a pair of hollow shoulder straps with bottom terminal ends of the shoulder straps integrally coupled to the belt in communication therewith. Also included is an inflation assembly for inflating both the belt and shoulder straps.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front view of a new inflatable life saving garment according to the present invention.

FIG. 2 is a side view of the present invention.

FIG. 3 is a detailed front view of the present invention.

FIG. 4 is a close-up cross-sectional view of the helium tank housing of the present invention.

DESCRIPTION OF THE PREFERRED EMBODIMENT

With reference now to the drawings, and in particular to FIGS. 1 through 4 thereof, a new inflatable life saving garment embodying the principles and concepts of the present invention and generally designated by the reference numeral 10 will be described.

The present invention, designated as numeral 10, includes a belt 12 having an outer sleeve 14 constructed from a flexible material. As shown in the Figures, the outer sleeve has a thin horizontally oriented rectangular configuration with a constant width and a hollow interior. The outer sleeve of the harness has a hollow tube 16 mounted therein which is constructed from an elastomeric material.

Also included is a pair of shoulder straps 18 each having an outer sleeve constructed from a flexible material and defined by a vertically oriented rectangular configuration with a constant width and a hollow interior. In the preferred embodiment, the shoulder straps each have a common width. Bottom terminal ends of the shoulder straps are integrally coupled in perpendicular relationship with the belt. The outer sleeve of each shoulder strap has a hollow tube 20 constructed from an elastomeric material mounted therein. The tubes of the shoulder straps each remain in communication with that of the belt.

While not specifically shown, it is preferred that a central extent of a rear portion of the belt is split with a pair of sealed terminal ends. Such ends are preferably coupleable by way of a buckle or the like. It should be further noted that the belt and shoulder straps may be constructed without the outer sleeve in an alternate embodiment.

Next provided is a back strap 22 coupled in perpendicular relationship between a central extent of a rear portion of the shoulder straps. In use, the back strap serves to maintain the shoulder straps in parallel. As shown in FIG. 3, a width of the back strap is similar to that of the shoulder straps and belt.

A helium assembly 23 includes a hollow cylindrical housing 24 with open ends mounted within the tube of the belt at a front extent thereof. A pair of plugs 26 each include a pivot arm 28 with a lower end pivotally mounted on a lower extent of an associated one of the ends of the housing. An upper end of the plugs extend through a sealed grommet 30 formed in a top of the tube. Mounted on a central extent of each pivot arm is a stopper 32.

A cylindrical helium tank 34 is mounted within the housing and is equipped with a pair of ends each having an outlet formed therein. Each pivot arm has an unbiased orientation with the stoppers each plugging the corresponding outlet of the helium tank for sealing the same. While helium gas is used in the preferred embodiment, it should be noted that other types of gas may be readily utilized in the alternative.

Finally, an actuation assembly 36 includes a pair of pull cords 38 each having a first end mounted to the upper end of an associated one of the pivot arms. A second end of each pull cord extends from a central extent of a front portion of the corresponding shoulder strap. As shown in FIG. 3, the second ends of the pull cords are integrally coupled such that a portion of the pull cord spans a chest of a user during use. A majority of a length of the pull cords are situated between the tube and the outer sleeve of the belt and shoulder straps.

In operation, the belt and the shoulder straps are adapted to inflate upon the second ends of the pull cords being pulled which in turn biases the pivot arms. It should be noted that the hollow tube has a sufficient elasticity so as to allow the biasing of the pivot arm. Furthermore, in alternate embodiments, the pivot arms may be equipped with sharpened tips for puncturing sealed ends of a tank. Yet another option is to equip the helium assembly with a color changing gas level indicator 40 for signaling when the tank must be filled or replaced.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An inflatable garment comprising, in combination:

a belt having an outer sleeve constructed from a flexible material and having a thin configuration with a hollow interior, the outer sleeve of the belt having a hollow tube mounted therein which is constructed from an elastomeric material;

a pair of shoulder straps each including an outer sleeve constructed from a flexible material with a hollow interior wherein bottom terminal ends of the shoulder straps are integrally coupled in perpendicular relationship with the belt, the outer sleeve of each shoulder strap having a hollow tube constructed from an elastomeric material mounted therein which remains in communication with that of the belt;

a back strap coupled in perpendicular relationship between a central extent of a rear portion of the shoulder straps in order to maintain the same in parallel;

a helium assembly including a hollow cylindrical housing with open ends mounted within the tube of the belt at a front extent thereof, a pair of plugs each including a pivot arm with a lower end pivotally mounted on a lower extent of an associated one of the ends of the housing and an upper end extending through a grommet formed in a top of the tube, a stopper mounted on a central extent of each pivot arm, and a cylindrical helium tank mounted within the housing with a pair of ends each having an outlet formed therein, wherein each pivot arm has an unbiased orientation with the stopper of each pivot arm plugging the corresponding outlet of the helium tank for sealing the same; and an actuation assembly including a pair of pull cords each having a first end mounted to the upper end of an associated one of the pivot arms and a second end extending from a central extent of a front portion of the corresponding shoulder strap, wherein the pull cords are situated between the tube and the outer sleeve of the belt and shoulder straps, wherein the belt and the shoulder straps are adapted to inflate upon the second ends of the pull cords being pulled which in turn biases the pivot arms.

2. An inflatable garment comprising:

a hollow belt;

a pair of hollow shoulder straps with bottom terminal ends of the shoulder straps integrally coupled to the belt in communication therewith; and inflation means for inflating both the belt and shoulder straps;

wherein the inflation means includes a gas tank;

wherein the gas tank is adapted to release gas upon the pulling of a pull cord;

wherein the pull cord includes a horizontally oriented portion which spans between the shoulder straps.

3. An inflatable garment as set forth in claim 2 wherein the shoulder straps are coupled in perpendicular relationship with the belt.

4. An inflatable garment as set forth in claim wherein the gas tank contains helium gas.

5. An inflatable garment as set forth in claim 2 wherein a back strap is mounted between a rear portion of the shoulder straps.

6. An inflatable garment as set forth in claim 2 wherein the belt and the shoulder straps each have a common width.

7. An inflatable garment comprising:

a hollow belt;

a gas tank mounted within the belt with a pair of ends each having a valve mounted thereon; and a pull cord connected to both valves for releasing gas into the belt from both ends of the gas tank upon the pull cord being pulled.

8. An inflatable garment as set forth in claim 7 wherein shoulder straps are coupled in perpendicular relationship with the belt.

9. An inflatable garment as set forth in claim 8 wherein a back strap is mounted between a rear portion of the shoulder straps.

10. An inflatable garment as set forth in claim 8 wherein the pull cord includes a horizontally oriented portion which spans between the shoulder straps.

11. An inflatable garment as set forth in claim 7 wherein the gas tank contains helium gas.

* * * * *